United States Patent [19]

Hughson et al.

[11] Patent Number: 4,526,232

[45] Date of Patent: Jul. 2, 1985

[54] METHOD OF REPLACING A CORRODED WELL CONDUCTOR IN AN OFFSHORE PLATFORM

[75] Inventors: Robert A. Hughson, New Orleans; Eddie A. Osborne, Kenner, both of La.

[73] Assignee: Shell Offshore Inc., Houston, Tex.

[21] Appl. No.: 513,566

[22] Filed: Jul. 14, 1983

[51] Int. Cl.[3] ..... E21B 29/12

[52] U.S. Cl. ..... 166/339; 166/344; 166/362; 166/277; 166/379; 166/380

[58] Field of Search ..... 166/55.6, 55.7, 277, 166/338, 339, 340, 342, 344, 345, 348, 351, 356, 359, 360, 361, 362, 379, 380; 285/15-17; 138/97

[56] References Cited

U.S. PATENT DOCUMENTS 1,528,560 3/1925 Myers et al. ..... 294/90
2,495,352 1/1950 Smith ..... 166/277
2,593,725 4/1952 Brown ..... 166/380
3,386,505 6/1968 Leonhardt, Jr. ..... 166/351

*Primary Examiner*—James A. Leppink
*Assistant Examiner*—Hoang C. Dang

[57] ABSTRACT

A method of replacing a corroded well conductor positioned in an oil production platform at an offshore location. After shutting in or killing the well, the wellhead is removed and the sections of the casing and tubing strings within the well conductor above the mud line are backed off and removed. The damaged well conductor is cut off above the mud line leaving a stub to which the lower end of a new section of well conductor is connected and bonded by means of a novel connector. Communication between the old and new sections of well conductor is established and the casing and tubing sections are re-installed in the new well conductor and the wellhead is closed.

7 Claims, 9 Drawing Figures

FIG. 2
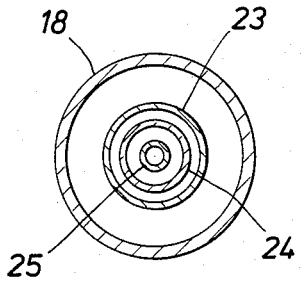
FIG. 3
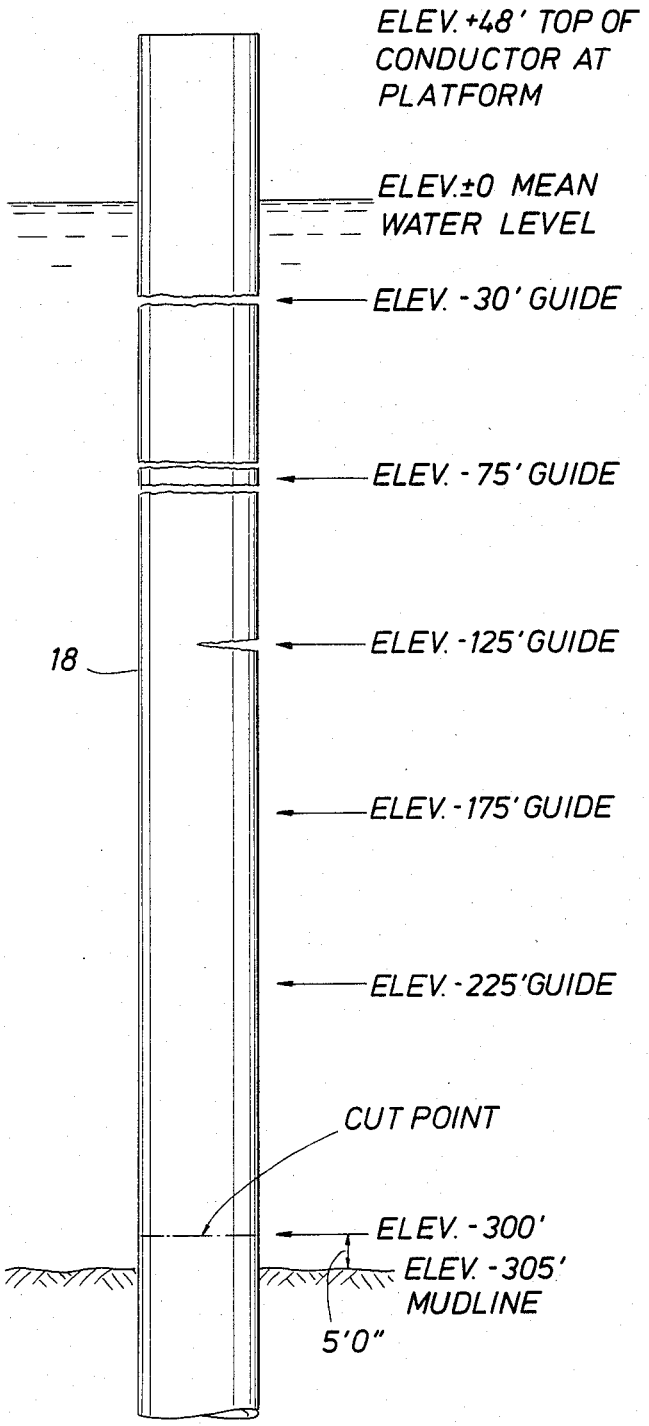
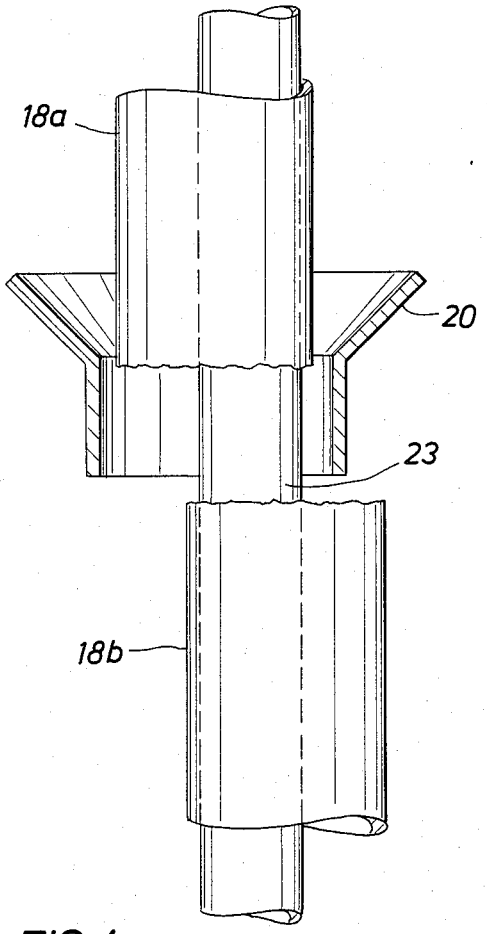
FIG. 4

METHOD OF REPLACING A CORRODED WELL CONDUCTOR IN AN OFFSHORE PLATFORM

BACKGROUND OF THE INVENTION

This invention relates to the replacement of a well conductor in an offshore platform having several producing oil and gas wells. An oil well is equipped with an inner production tubing position within one or more concentric strings of pipe or well casing which in turn are surrounded by a large-diameter pipe string, known as a "well conductor" which extends from the deck of the platform to several hundred feet into the ocean floor. The well conductor generally supports the weight of the wellhead and at least a portion of the weight of the strings of tubing and casing hung in the well. The well conductor also protects the inner pipe strings from wave action and corrosion.

In the event that a well conductor became corroded, it has been a practice to patch it up by welding more metal over the corroded areas. This calls for underwater welding which is difficult to carry out and inspect, and is not practical on deep platforms which are in 1,000 feet or more of water. For severely corroded or damaged well conductors, it has been the practice to abandon the well and drill another if there is an extra slot or wellbay on the platform.

SUMMARY OF THE INVENTION

Rather than attempt to mend or repair damaged or corroded well conductors on platforms at offshore locations, a method has been developed to remove any or all of a damaged well conductor above the ocean floor and replace it with a new upper section of conductor. This is done in a manner such that only the well being repaired has to be shut in so that there is no loss of production from the other wells on the platform which can keep flowing. As it is hazardous to carry out welding operations on a platform, the present method can be carried out without welding.

In practice of this invention, a producing well is shut in or killed, the wellhead is opened and the tubing and casing strings are closed or plugged and then removed from about 25 feet below the ocean floor or mud line. The damaged empty well conductor is cut off about 5 feet above the ocean floor. A new well conductor is made up as it is lowered down through the platform into register with the stub of the old well conductor sticking up from the ocean floor. A connector carried by the lower end of the new conductor is stabbed into the open end of the stub and subsequently bonded thereto. After removing closure plugs the casing and tubing strings are reinstalled in the wellhead and hung from the wellhead which is then closed.

BRIEF DESCRIPTION OF THE DRAWING

FIG. 2 is a cross-sectional view of the concentric arrangement of tubing, casing and well conductor of a typical well;

FIG. 3 is a schematic view illustrating the corrosion that has taken place in a well conductor after being at an offshore location for a number of years;

FIG. 4 is a diagrammatic view, taken in partial cross section, showing the results of corrosion on a well conductor passing through a bellguide on an offshore platform;

DESCRIPTION OF A PREFERRED EMBODIMENT

Figure 1:
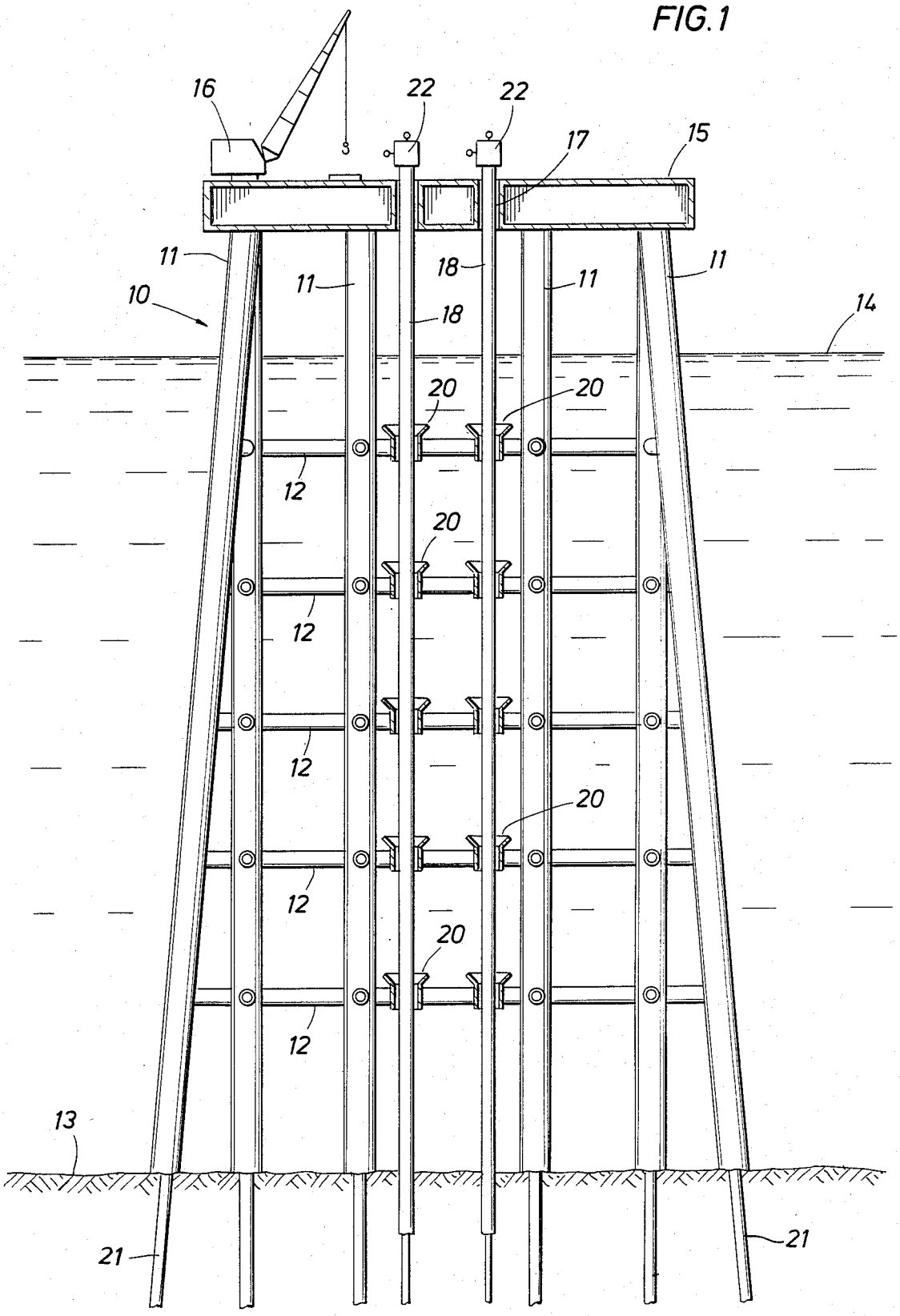
FIG. 1 is a diagrammatic view, taken in cross section, of an offshore platform showing two of the well conductors thereof.

Referring to FIG. 1 of the drawing, an offshore platform is generally represented by numeral 10 which may comprise a plurality of elongated tubular legs 11, which are interconnected by any arrangement of cross-bracing members 12. The legs 11 extend substantially vertically from the sea bed or ocean floor 13 to a suitable level, say 50 feet, above the mean water line 14 where they support one or more operating and/or storage decks 15. The deck may be provided with at least one hoist unit 16 for handling pipe and other equipment on the platform.

The upper and lower floors of the deck 15 are provided with one or more wellbays or openings 17 therethrough through which a well conductor 18 is passed at the start of well drilling operations. A well conductor 18 is generally heavy-walled pipe, say, 20 inches in diameter, which is made up of 30 or 40 foot sections of pipe which are welded or screw-threaded together, in a manner well known to the art, on the deck 15 of the platform 10 and then lowered through opening 17. A platform may have from 1 to 80 well conductors depending on the number of wells to be drilled.

A deep-water platform 10, say one located in 300 feet of water, may be equipped with a series of bellguides 20 which are secured, as by welding, to the cross-bracing members 12 of the platform 10 when it is fabricated on land. The platform of FIG. 1 is illustrated as being equipped with five bellguides 20 which are in vertical alignment and are located at, say, 30, 75, 125, 175 and 225 feet, respectively, below the mean water level 14 where the platform is located. If desired, the bellguides 20 may be displaced laterally an increasing amount from top to bottom so that a centerline passing through the bellguides falls in a downwardly and outwardly directed curved line in the event that curved conductors are to be used in a manner well known to the art.

The platform 10 is generally secured to the ocean floor 13 by driving piles 21 down through the tubular legs 11 into the ocean floor where they may be cemented in place. During the drilling of a well through a well conductor 18, one or more strings of casing and one or more tubing strings are run into the well and are hung from and/or supported by a wellhead 22 which closes the top of the well and conductor 18 during production operations. In FIG. 2 a typical cross section of the tubulars in a well is illustrated as comprising the well conductor 18 and two concentric well casings 23 and 24 which in turn surround a production tubing string 25.

In a typical well installation, a 20 inch diameter well conductor 18 is made up on the platform 10, section by section being connected together in end-to-end relationship, and lowered through the wellbay 17 and then down through the bell guides 20 to the ocean floor 13. Additional sections of pipe are secured to the top of the well conductor 18 as it is driven into the ocean floor 13, say to a depth of 250 feet, by the use of a pile driver in a manner well known to the art. Well drilling operations are carried out through the well conductor 18 down to, say, 2,000 feet. A string of casing 23, say 10¾ inches in diameter, is run into the hole, hung from the wellhead 22 and cemented in place. Well drilling operations are continued to, say, 10,000 feet and another string of casing 24 is run into the well, hung from the wellhead 22 and cemented in place. This casing string 24 may be 7 inches in diameter and may surround a 2½ inch tubing string, represented by numeral 25.

It is a general practice to protect offshore platforms against electrolytic corrosion either by equiping it with an impressed-current cathodic protection system or with sacrificial anodes, or by both. Even though such equipment is used, the environmental factors at a platform location may change over the years resulting in inadequate protection to well conductors on many of the platforms that have been in the water over ten years. An inspection of a multi-well platform revealed an excessive amount of corrosion on the well conductors 18 where they passed through the wellguides 20. At the 30 foot bellguide, about 30% of the well conductors were severed and another 20% were severed from 25% to 80%. At the 75 foot bellguide, 40% of the well conductors were severed and another 35% were partially severed from 15% to 50%, with lesser damage on the other conductors and at the deeper bellguide levels on all conductors.

A typical damaged well conductor 18 is shown in FIG. 3 as having been completely severed by corrosion opposite the location of the two uppermost bellguides 20 located 30 and 75 feet, respectively, below the mean water level. In addition, the well conductor was 50% severed by corrosion opposite the bellguide located 125 feet below the water surface, while deep corrosion or holes were found in the conductor wall opposite the deepest bellguides.

In some cases, after the well conductor 18 (FIG. 4) was completely severed into portions 18*a* and 18*b*, the lower portion 18*b* of the conductor had sufficient corrosion at the severance so that the lower severed conductor portion 18*b* came out of the bellguide 20, exposing the 10¾" casing 23 to deflection-induced bending and localized stresses caused by upper end of conductor portion 18*b* as it whangs back and forth laterally with wave action. At the same time, the casing 23 is subjected to added corrosion as sea water is able to enter the annulus between the well conductor 18 and the casing 23.

In view of the fact that the condition of the basic platform may be good and the oil field may be produced for many more years, a method was developed whereby a damaged well conductor could be repaired in a safe manner without shutting down the platform or shutting in the rest of the wells.

Figure 5:
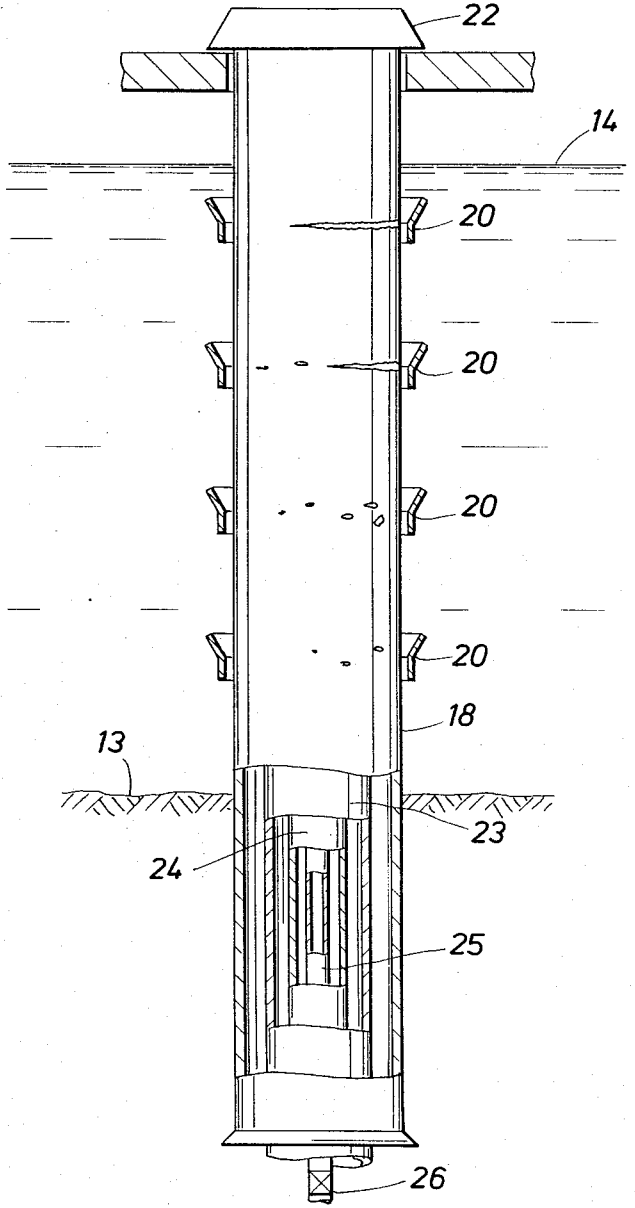
FIG. 5 is a schematic view, taken in partial cross section, of the arrangement of tubulars of a producing well at an offshore location where the well shows severe corrosion.

A typical well conductor 18 that is to be cut off and replaced is diagrammatically illustrated in FIG. 5 as being closed at the top by a wellhead 22. Opposite the uppermost bellguide 20, the conductor is badly corroded and about 75% severed. Opposite the next lowermost bellguide, the conductor is about 40% severed. There is further severe corrosion and holes in the conductor opposite all of the bellguides.

At the start of the repair operation the well is shut in so as to stop the flow of fluid from the well. This may be done by closing a valve 26 which may be provided in the production tubing string in a manner well known to the art. Alternatively, a tubing plug could be run down the tubing 25, as by means of a wireline lubicator which would be mounted on the wellhead in a manner used on land wells. Flow from the well may also be stopped by killing the well, i.e., pumping a heavy fluid down the tubing.

With flow from the well stopped, the wellhead 22 is opened so that the tubing string can be unscrewed, one or more sections at a time, and pulled out of the well. The last joint of tubing to be removed would be the one Just above a tubing plug or valve 26. The same operation would be carried out to remove the upper sections of the casing strings 23 and 24, preferably after closure plugs 27 and 28 had been run into and set in casings 23 and 24.

With the upper sections of tubing string 25 and casing strings 23 and 24 removed to a point well below the mud line 13, the well conductor 18 is cut off at any desired location above the mud line, say 5 feet. In shallow water, the well conductor may be cut by divers using any suitable cutting apparatus. In extremely deep water, inside or outside casing cutters well known to the art may be run on a pipe string or wireline to make the cut. Alternatively, tools for Jetting an abrasive fluid may be used. If desired, the cut may be provided a smooth finish by use of well known milling tools. If divers are used, a template may be secured around the conductor to aid in providing a smooth horizontal cut which is perpendicular to the axis of the conductor. After cutting the conductor, a short conductor stub portion 18*a* extends above the ocean floor as shown in FIG. 6.

Figure 7:
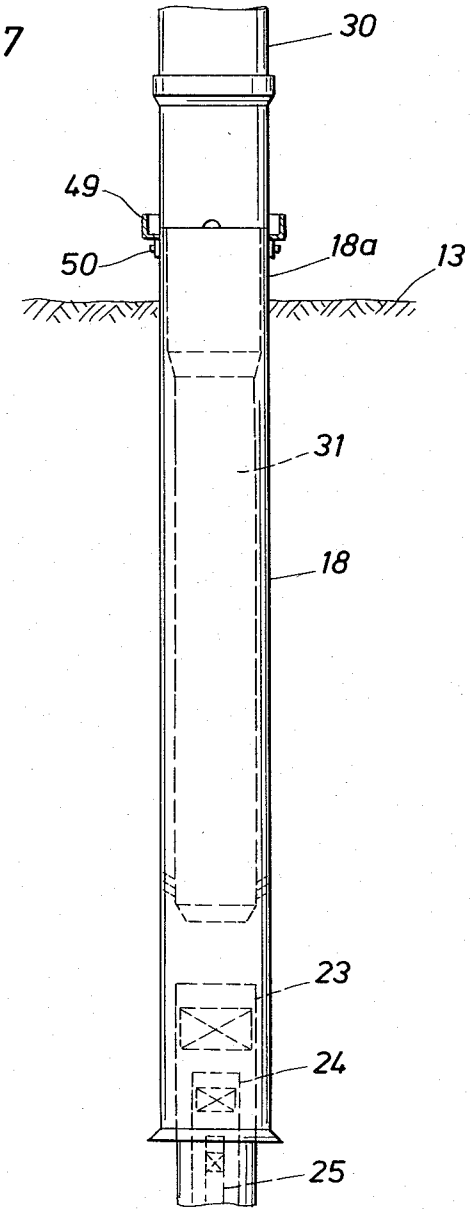
FIG. 7 is a diagrammatic view illustrating an offshore well into which a new well conductor has been stabbed and connected.
Figure 6:
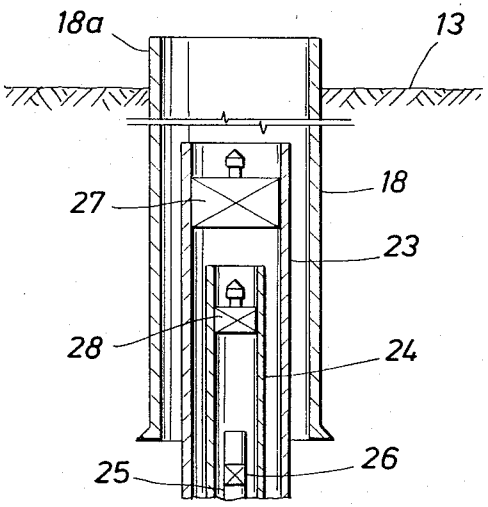
FIG. 6 is a schematic view, taken in cross section, of the arrangement of the tubulars in a well after the well conductor has been cut off close to the ocean floor.

FIG. 7 illustrates well arrangement of FIG. 6 after a new section of well conductor 30 has been positioned on top of the conductor stub 18*a*. The new conductor section 30 is provided at its lower end with an elongated tubular connector member 31 which is of a diameter selected to fit telescopically either inside or outside the well stub 18*a*. If an inside stab-type connector is utilized, as shown in FIG. 7, it is essential that the distance between the top or shoulder of the conductor stub 18*a* and the top of the next concentric well casing 23 be greater than the length of the stab-type connector 31 below its seating shoulder 32.

Figure 8:
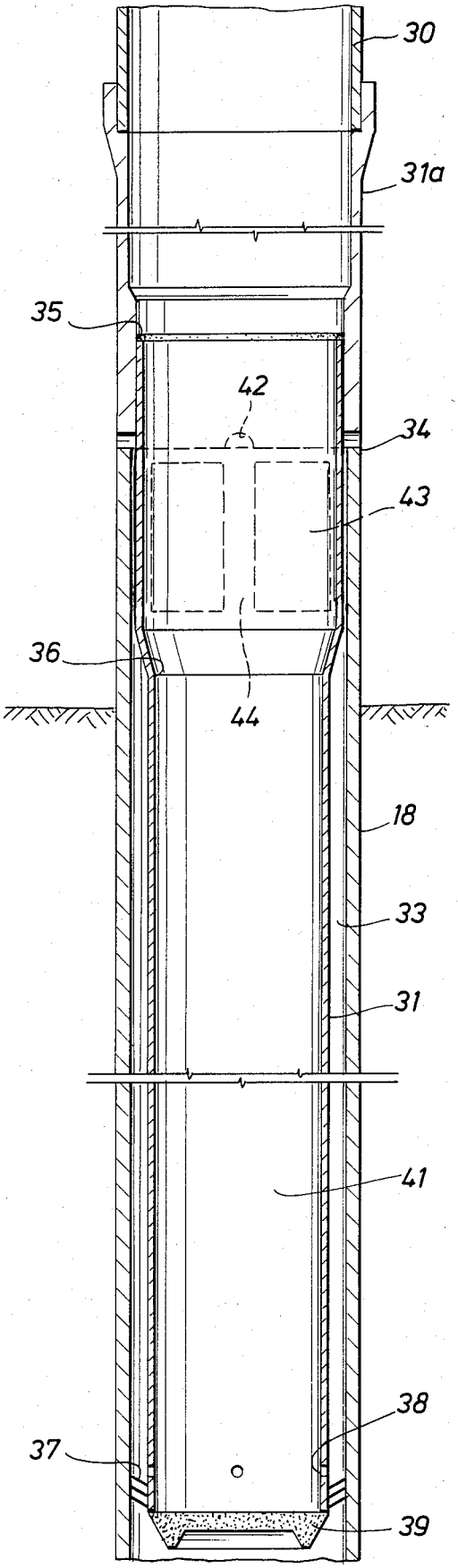
FIG. 8 is a schematic view, taken in cross section, illustrating a stab-in type connector for use in practicing the method of the present invention.
Figure 9:
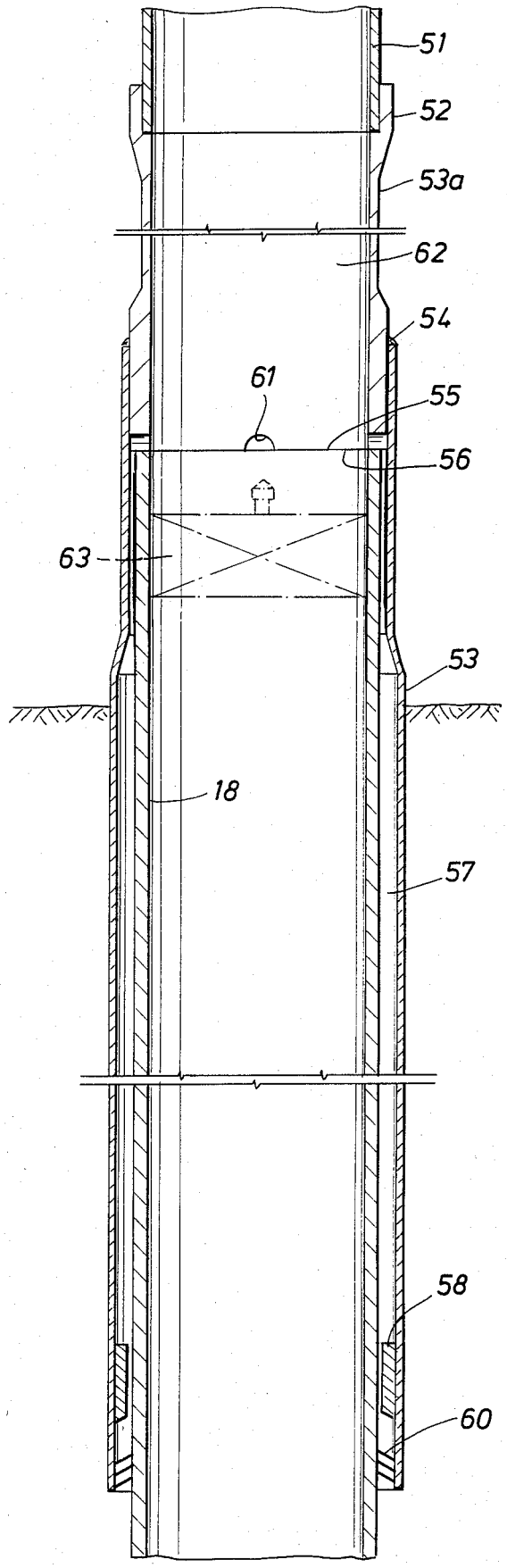
FIG. 9 is a schematic view, taken in cross section, illustrating an overshot type connector for use in practicing the method of the present invention.

One form each of an undershot and an overshot tubular connector, for use in the method of the present invention, is shown in FIGS. 8 and 9, respectively. The undershot tubular connector of FIG. 8 comprises upper and lower tubular portions 31*a* and 31, respectively, which are connected together at point 34, as by welding or screw threads, above a seating shoulder 35 which is adapted to seat on the upper cut-off face of the well conductor stub 18*a*. In order to fit in a 20 inch O.D. conductor stub 18*a*, the stab-in connector 31 is made of pipe of a smaller diameter, say 18 inch O.D., which in turn may be swaged down, as at 36, to a 16 inch O.D. tubular, if desired. This allows about a 3 inch annular space 33 between the connector 31 and the conductor 18. In order to achieve a strong connection between the conductor 18 and the stab-in connector 31, it is proposed to pump a cement or other suitable bonding material in the annular space 33 which is closed at lower end by flexible wiper cups 37 or a slidable seal of any other suitable design.

The wiper cups 37 may be secured to the lower end of the tubular stab-in connector 31 on the outer wall thereof, or may be secured to a drillable cementing shoe 39 which is secured to and closes the lower end of connector 31. Positioned above the wiper cups 37 and extending through the wall of the connector 31 are one or more fluid ports 38 allowing a bonding material to flow from the bore 41. The upper end of the annular space 33 is in communication with the ocean surrounding the well stub 18*a* through suitable fluid ports, for example, by ports 42 through the wall of the upper connector portion 31*a* located, preferably, just above the upper edge or seating shoulder of the conductor stub 18*a*.

In order to be assured that the tubular connector 31 is concentrically positioned within the conductor stub 18 so that bonding material of uniform thickness is formed in the annular space 33, a series of tapered shims or wedges 43 are secured, as by welding, to the outer surface of the tubular connector 31. The shims may be of a thickness so as to come within $\frac{1}{8}$ of an inch of the inner wall of the conductor stub 18 when the connector 31 is concentrically positioned within the stub 18. The shims 43 are spaced apart circumferentially so that vertical flow passages 44 are formed between them to allow the bonding material to flow or be forced up the annulus 33, through the flow passages 44, to be discharged through ports 42. Prior to carrying out the present method, the well conductor stub may be suitably cleaned in any well known manner, as by a wire brush actuated by means of a motor and operated by a diver or operated at the end of a pipe string from the platform, to get a better bonding surface.

In practicing the method of the present invention, the connector apparatus described with regard to FIG. 8 is connected to a new section of well conductor 30 on the deck 15 of the platform 10 (FIG. 1) and is lowered down the vertical opening 17 from which an old corroded well conductor had been removed after it was cut off just above the ocean floor. Additional sections of well conductor are connected end-to-end, one at a time, as the assembled new well conductor 30 is lowered through the bellguides 20 and the stab-in connector 31, at the lower end of the new well conductor, is stabbed into and seats on the upper edge of the well conductor stub 18*a* sticking up from the ocean floor (FIGS. 7 and 8).

A normal cementing operation is now carried out with cement or another bonding fluid being pumped down through the new well conductor to be followed by a plug and water in any cementing procedure well known to the art. On reaching the shoe 39, the flowing bonding fluid is forced out fluid ports 38 and upwardly through the annulus 33, past the shims 43 through flow passage 44, to be discharged out fluid ports 42 into the ocean. The bonding material is allowed to harden before the well connector is opened to put the old well conductor 18 in fluid communication with the new well conductor 30.

If desired, in waters where divers may be used an additional seal on the outside of the conductor may. be formed where the new conductor-connector section 31*a* shoulders on the top of the conductor stub 18*a* so as to seal this point and the ports 42 from the outside. For example, as shown in FIG. 7, a sealing channel 49 for holding a hardenable liquid sealant may be provided with suitable clamps 50. After clamping the trough or channel in place, the diver would fill it with liquid sealant of a type which will set up in sea water.

After the bonding material in the annulus 33 has hardened, a clean-out tool or drill is lowered on a pipe string to punch out or drill the friable or drillable shoe 39 and any bonding material thereabove (FIG. 8) so as to achieve open communication between the old and new well conductors 18 and 30. The well casing plugs 27 and 28 in casings 23 and 24 are then removed and the sections of both casings which were removed from the well prior to its repair would be re-run into the well through the new well conductor. Subsequently, the tubing string 25 would be re-run in the innermost casing. After the wellhead 22 had been closed, the valve 26 in the tubing 25 would be opened to place the well on production.

Referring to FIG. 9 of the drawing, a new or replacement well conductor 51 is shown as being screw-threaded as at 52, to the upper portion 53*a* of an overshot-type tubular connector which is welded, as at 54, to a lower downwardly-extending tubular member 53. The lower end of the upper portion 53*a* forms a landing surface 55 of a size to mate with the shoulder 56 formed at the top of the old well conductor stub 18. The diameter of the overshot lower portion 53 of the connector is sufficiently large so that an annulus 57 at least 1 inch wide, and preferably about 3 inches wide, is formed between the inner wall of member 53 and the outer wall of conductor stub 18. Because of the large diameter of an overshot type connector, as shown in FIG. 9, it can only be used in special repair jobs, such as in shallow water where bellguides are not used on a platform. The bellguides on a platform are not generally large enough to allow an overshot connector to pass through them.

The lower end of the lower tubular portion 53 is provided with a series of spacer or centralizer blocks or shims 58 which are secured, as by welding to the inner surface thereof. Additionally, flexible wiper cups 60 are mounted on the inner wall of member 53 near the lower end thereof to contain a bonding fluid material when it is pumped into the annulus 57. A series of fluid ports 61 are provided in the connector wall portion 53*a* at a point above the shoulder 56 formed at the top of conductor stub 18. The ports 61 are in communication between the bore 62 of the upper connector portion 53*a* and the annulus 57.

In securing the overshot connector 53-43*a* to the conductor stub 18 after it has been seated thereon, a removable or drillable cementing plug 63 of any well known type would be set in the top of the conductor stub 18. Thus, a bonding material, such as cement, would be introduced into the bore 62 of the connector 53*a* above the plug 63, and would flow out the ports 61 into the annulus 57 and then down the annulus to the wiper cups 60 to bond the connector 53-53*a*, at the lower end of the new well conductor 51, to the conductor stub 18. After the bonding material has hardened, the plug 63 and any material left in the bore 62 above it may be drilled out. The original tubing and casing strings could then be installed in the well and the wellhead secured thereto in a manner described hereinabove with regard to the stab-in type connector.

We claim as our invention:

1. Method of replacing a damaged portion of large-diameter well conductor pipe which is closed at the top by a wellhead and extends downwardly through close-fitting circular guide means in the underwater substructure of an offshore platform and into a well previously drilled in the ocean floor, said method comprising, stopping the flow of fluid from the well, opening the wellhead at the top of the well conductor, removing at least the upper portions of the concentric tubing and casing strings within the upper part of the well conductor to a point below that portion of well conductor to be cut off and replace, cutting off the upper damaged portion of the well conductor at a point above the mud line into which the well conductor extends so as to leave a well conductor stub to connect to, removing the cut-off damaged portion of well conductor from its position over the well conductor stub, making up a replacement upper portion for the well conductor of a length substantially equal to the damaged original upper portion that was removed, fixedly securing an elongated lower tubular connector member to the lower end of the replacement conductor portion, said elongated lower tubular connector member being of a diameter to pass through said platform guide means and fit telescopically within the interior of the well conductor stub, sizing the diameter of the lower connector tubular member such that is seats on the well conductor stub in a radially spaced telescoping manner, with the space between said member and a sub forming cement flow passages of a length sufficient to contain a cement bond between said member and the interior wall of said stub, assembling and positioning said replacement conductor portion, with its tubular connector member at the lower end thereof, above the well conductor stub extending up from the ocean floor, lowering said tubular connector member through said platform guide means into telescoping spaced engagement with the interior of the well stub and seating the replacement conductor portion on the well stub so as to extend within the well stub, pumping cement down through said tubular connector member and out the lower end thereof and up the annular space formed between the tubular connector member and the interior wall of said well stub over substantially the telescoping length thereof, allowing the cement to harden in the annular space, removing any material from the bore of the replacement conductor portion and the tubular connector attached thereto to place the open top of the replacement conductor portion in open communication with the upper ends of the concentric tubing and casing strings within the well, re-installing in the replacement conductor portion the concentric tubing and casing portions and connecting them to the tubing and casing portions that were left in the well, and re-installing and closing the wellhead at the top of the replacement conductor portion.

2. The method of claim 1 including the step of providing the connector tubular member with a seating shoulder adapted to engage the top of the well conductor stub.

3. The method of claim 1 including the step of uniformly spacing the lower connector member relative to the interior wall of said well conductor stub to obtain a bond therebetween of substantially uniform thickness.

4. The method of claim 1 including the step of cleaning the interior surface of the well stub adjacent the tubular connector member prior to pumping cement into the annular space between said connector member and said well stub.

5. The method of claim 1 wherein the step of sizing the diameter of the lower connector tubular member is such that it fits within the well conductor stub in a spaced telescoping manner for a distance at least 5 times the diameter of the well conductor stub.

6. The method of claim 5 including the step of forming a shoulder on the top of the well conductor stub on which the tubular connector member is subsequently seated.

7. The method of claim 1 including the step of providing a flexible seal in the lower end of the annulus to close the annulus between the tubular connector member and the interior wall of said well stub prior to pumping cement in the annulus.

* * * * *